US006431489B1

(12) United States Patent
Rose

(10) Patent No.: US 6,431,489 B1
(45) Date of Patent: Aug. 13, 2002

(54) CHRISTMAS LIGHT STORAGE DEVICE

(76) Inventor: Michael L. Rose, 4720 N. Maple Grove Rd., Boise, ID (US) 83704

( * ) Notice: Subject to any disclaimer, the term of this patent is extended or adjusted under 35 U.S.C. 154(b) by 0 days.

(21) Appl. No.: 09/840,697

(22) Filed: Apr. 23, 2001

(51) Int. Cl.[7] ..... B65H 75/28; B65H 75/40
(52) U.S. Cl. ..... 242/405.2; 242/402; 242/407
(58) Field of Search ..... 242/405.1, 405.2, 242/402, 407; 206/419, 420, 225, 226

(56) References Cited

U.S. PATENT DOCUMENTS

| | | | | | |
|---|---|---|---|---|---|
| 1,024,089 | A | | 4/1912 | Magee | |
| 1,330,093 | A | * | 2/1920 | Robertson | 242/405.2 |
| 1,552,082 | A | * | 9/1925 | Riley | 242/918 |
| 3,011,734 | A | * | 12/1961 | Wilkinson | 242/918 |
| 3,201,059 | A | | 8/1965 | Winkel | |
| 3,460,779 | A | * | 8/1969 | Peasley | 242/405.1 |
| 3,584,803 | A | * | 6/1971 | Williams | 242/405.2 |
| 3,921,927 | A | | 11/1975 | Esashi et al. | |
| 4,917,323 | A | | 4/1990 | Wing | |
| 5,381,984 | A | * | 1/1995 | Hindsgual | 242/918 |
| 5,404,670 | A | * | 4/1995 | Noll | 242/405.1 |
| 5,641,075 | A | | 6/1997 | Mechlin | 211/26 |
| 5,676,250 | A | | 10/1997 | Walters | 206/419 |
| 5,695,148 | A | | 12/1997 | Christensen | 242/405.3 |
| 5,762,311 | A | | 6/1998 | Triglia | 248/523 |
| 5,924,570 | A | * | 7/1999 | Sickles | 206/419 |
| 5,957,401 | A | | 9/1999 | O'Donnell | 242/404.3 |
| 5,975,455 | A | * | 11/1999 | Alegre | 242/407 |

* cited by examiner

*Primary Examiner*—John M. Jillions
(74) *Attorney, Agent, or Firm*—Holland & Hart LLP

(57) ABSTRACT

A storage device for storing strings Christmas, holiday or other strings of lights when the strings of lights are not in use. The device has an end having slots therethrough through which one or more of the ends of the string of lights are placed. A cap is then utilized to hold the light string end in position while the string itself is wound around the exterior surface of the storage device.

18 Claims, 6 Drawing Sheets

CHRISTMAS LIGHT STORAGE DEVICE

BACKGROUND OF THE INVENTION

The present invention generally relates to storage devices, and more particularly to devices utilized to store strings of Christmas and other holiday lights.

Users of holiday lights, such as Christmas lights, often find a great annoyance in the storage of such lights. Stringed lights are typically packaged in prepackaged plastic wrappings placed in cardboard boxes, such packaging not easily allowing the user to compactly and securely store such lights after they have been used. Typically, a user is left with the prospect of winding up, balling up, wadding up, or boxing up their lights and storing them until the next holiday season arrives. Then, when the user unpacks, unwinds, and unknots these balls of rogue strings, such an experience is found to be extremely frustrating. Lost equipment, such as fuses and hangers is also an issue. The inability to easily check for broken/burnt out bulbs and replace them is a constant problem.

Numerous attempts have been made to accomplish the task of light string storage. A first example is U.S. Pat. No. 4,917,323 to Wing for a Christmas light storage device. The Wing device consists of one or more disks, each with a plurality of radially oriented slots around the outside circumference of the disks for allowing the wires of light sockets to be inserted through these slots.

The second device is shown in Mechlin, U.S. Pat. No. 5,641,075, and shows a storage rack and method for storing string lighting. The Mechlin rack has a tubular body having a number of slots opening at one end wherein the light bulbs are stored within the slots themselves. Another device is shown in Walters, U.S. Pat. No. 5,676,250. The Walters device shows a light string mounting storage system comprising a tube having end caps. The tube has a solitary notch in each end for allowing a user to store the electrical connection of the light string inside the tube.

Another light storage device is shown in Christensen, U.S. Pat. No. 5,695,148. The Christensen device is reel on which Christmas lights can be wound.

And finally, U.S. Pat. No. 5,957,401 to O'Donnell shows a device for storing a string of lights. The O'Donnell device is in the spool form.

These devices tried to make storage more convenient and easy. However, none of these devices allows for ease of use, both installing and taking down light strings, expediency, relatively tangle-free storage, and a convenient means of verifying the functionality of the lights on the light string. A need exists for an inexpensive and easy to use device and method for the storage of strings of lights and related accessories.

SUMMARY OF THE INVENTION

The present invention is a storage device for storing at least one string of Christmas or other holiday lights. Such a string of Christmas lights will have a plurality of light bulbs which are typically connected together by two or three wires. This string of lights will have a string first end which terminates at a first electrical plug, and a string second end which terminates at a second electrical plug, these electrical plugs being coupled to the wires.

The preferred embodiment of the invented storage device utilizes a hollow tube having a side wall. This side wall has a length and an exterior surface. The tube has a first end and second end. The preferred hollow tube is cylindrical in shape. The first end of the hollow tube has at least two first end notches directed into and through the side wall. It is preferred that these end notches be opposite one another on the first end. Likewise, in the preferred embodiment, the second end of the tube has also at least two second end notches through the side wall. These notches extend from the end of the tube towards the center of the tube within the side wall of the tube.

Provided are also caps for the first and second end, with these caps being able to be removably attached and detached. In use, a user would place the string of lights first end through the tubes first end notches with the electrical plug extending outside of the storage device, the wires extending through the device, and the wires then extending through the second of the first end notch to the outside portion of the device. An end cap would then be coupled to the first end thereby holding the first electrical plug and string first end in place. The user would then be able to wind the string of lights around the exterior surface of the storage device. When all but the second end had been wound around the exterior surface of the storage device, the user would then place the string second end through the tube second end slots so that the second electrical plug extends back through the slots to the outside portion of the device. Then the user would couple the second end cap to the second end, thereby holding the second electrical plug and string second end to the hollow tube. Additionally, a handle means may be provided for allowing the user to easily store and/or unwind the string of lights attached to the storage device.

It is a first object of the present invention to provide a secure and convenient place to store Christmas lights. It is a second object of the present invention to provide a Christmas light storage device which allows the user to test and replace lights stored thereon without removing the string of lights from the device or disassembling the device. It is a third object of the present invention to provide a means for easily unstoring stored Christmas lights. It is a fourth object of the present invention to keep the light string from tangling and support attachments and bulbs with each string of lights. It is a fifth object of the present inventions to provide storage place for spare light bulbs, fuses, hangers and other accessories.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive.

DESCRIPTION OF THE PREFERRED EMBODIMENTS

Figure 1:
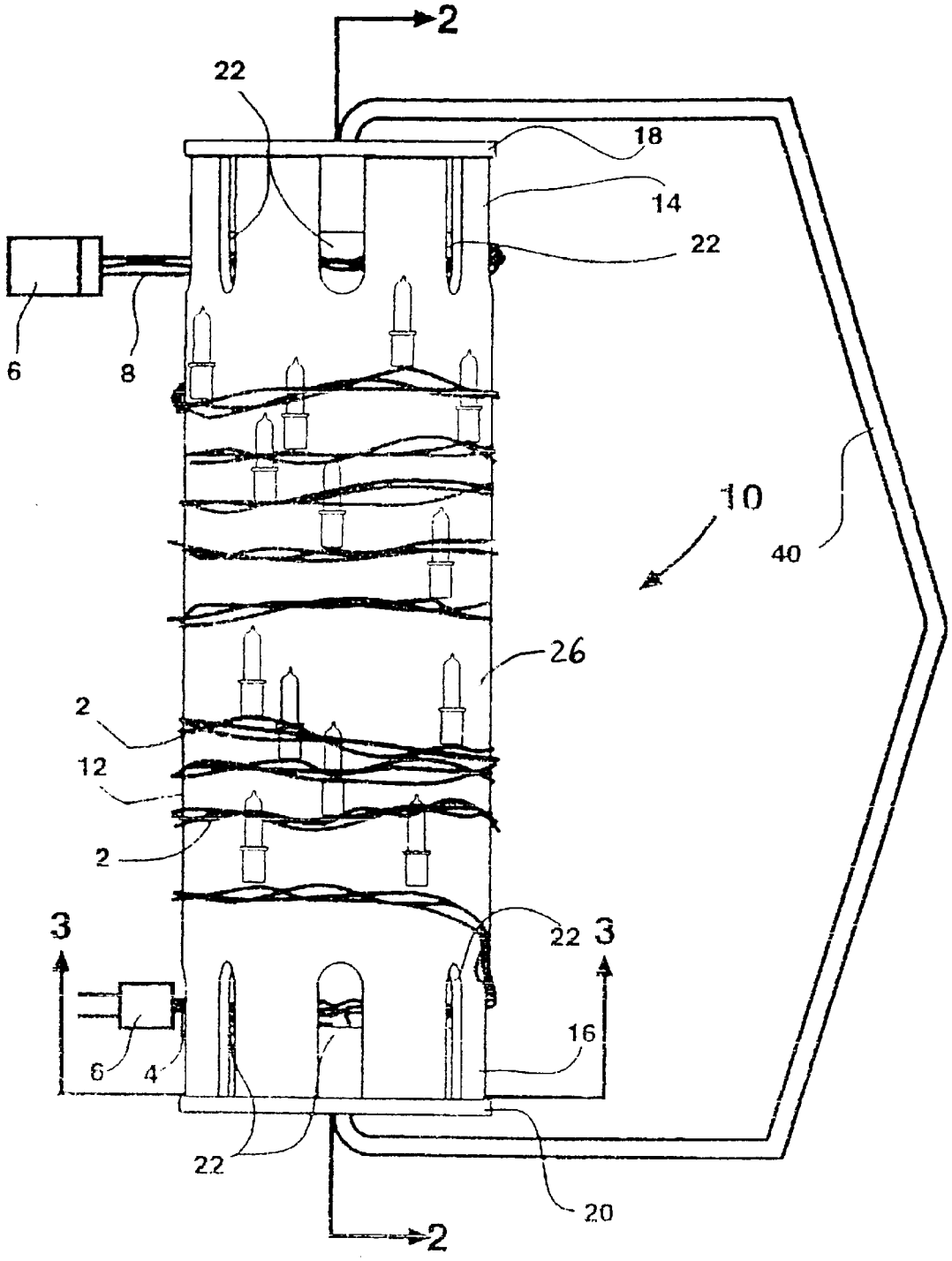
FIG. 1 is a first side view of one embodiment of the present invention.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

The present invention is a storage device for storing Christmas, holiday, or other stringed lights. Referring initially to FIG. 1, one embodiment of the invented storage device 10 is shown. The storage device 10 has a body 12 having an exterior surface 26 around which the Christmas light string can be wound. In the preferred embodiment, the body 12 comprises a tube having a hollow center, more particularly a round plastic cylinder of length between 10 to 20 inches. The preferred diameter of such a round cylinder being 1.75 to 3.0 inches. Being a cylinder makes it easier to wrap and unwrap the Christmas light string. Being hollow allows for storage of spare light bulbs, fuses, hangers, and other accessories.

It is expressly envisioned that other embodiments could be created of solid cylinders of or other shapes, including prisms. Likewise, throughout this disclosure, other dimensions, variables, materials, shapes, sizes and the like are envisioned, with the above and below discussion only intended to express what the preferred embodiment of some of the alternative embodiments entail.

Figure 2:
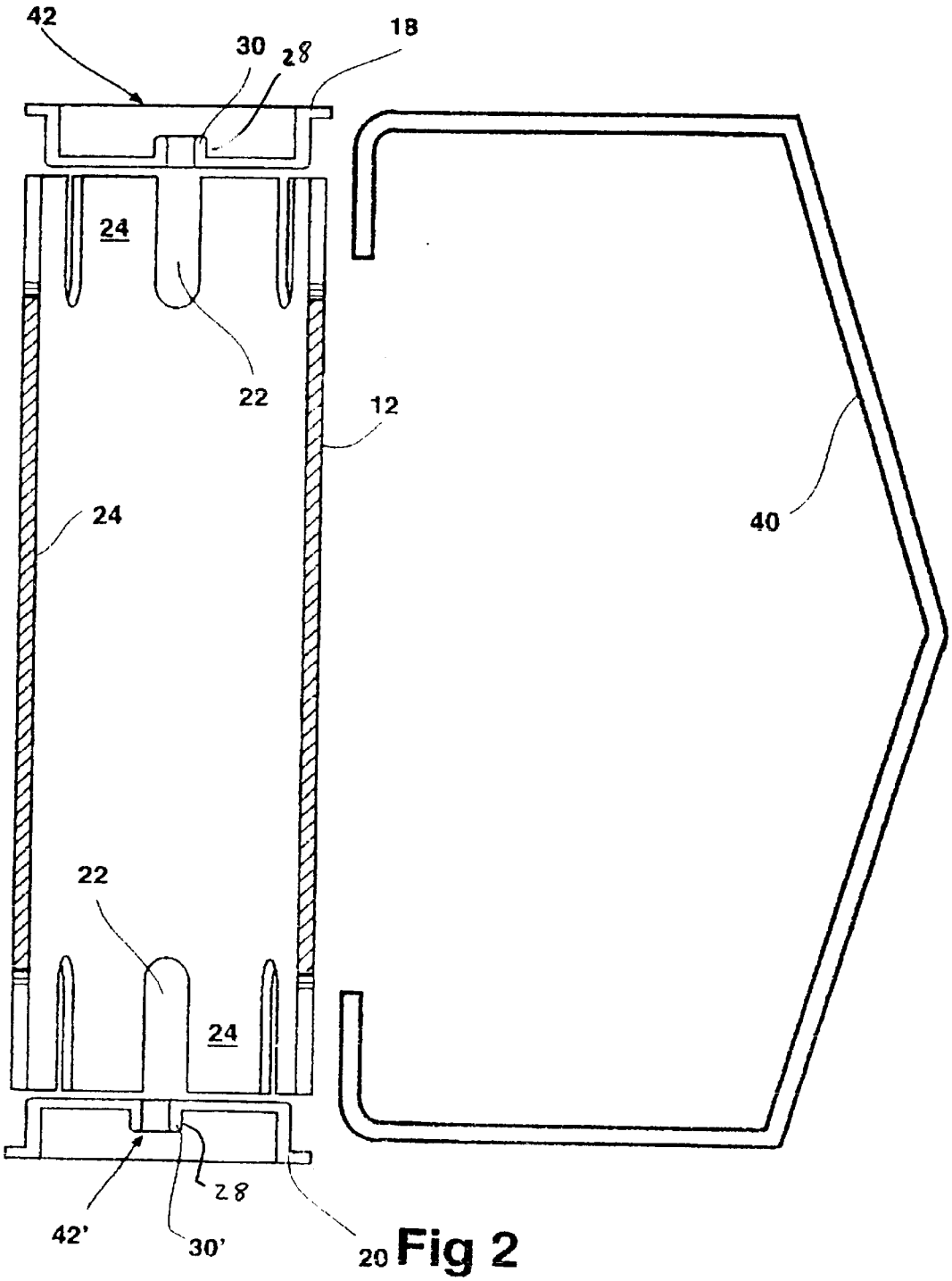
FIG. 2 is a cross sectional view of the embodiment of FIG. 1.

The body 12 has a first end 14 opposite a second end 16. The first end 14 has a number of slots or notches 22 through the side wall (as shown in FIG. 2). It is preferred that there be at least two of said slots 22 through the body 12, thereby allowing the second end 8 of the Christmas light string 2 with the attached plug 6 to extend therethrough from one slot to the other slot as shown in FIG. 1. Obviously, which end of the light string 2 extends through which end of the body 12 is merely a matter of user choice, and referring specifically to the first end 4 extending through the tube first end 14 is not intended as a limitation. In the preferred embodiment, eight equally slots spaced notches 22 of 0.1875 inch in width and 0.625 inch in length are utilized. The walls of these notches/slots 22 will be preferably smooth and rounded so as to protect the string of lights.

Likewise, the second end 16 has a number of slots 22. As with the first end, the second end likewise has at least two slots for allowing the first end 4 of the Christmas light string 2 and the attached plug 6' to be inserted therethrough. In the preferred embodiment, eight equally slots spaced notches 22 of 0.1875 inch in width and 0.625 inch in length are utilized. The walls of these notches/slots 22 will be preferably smooth and rounded so as to protect the string of lights.

It is preferred that each end (14, 16) of the body 12 be slightly rounded and slightly larger than the body in diameter (for instance 0.0625 inch larger diameter). Doing so will assist in the attachment of caps (18, 20) to the body 12 in the preferred embodiment.

Releasably coupling the first end 14 is a first cap 18. The embodiment shown in FIG. 1 utilizes a cap which snaps inside of the body 12, however, other cap pin means are also envisioned, including buckles, snaps, caps which attach to the outside 26 of the body 12, caps which snap on the outside 26 of the body 12, etc. Likewise, a second cap 20 is able to engage the second end 16. In the preferred embodiment these caps 18, 20 are identical and interchangeable. The preferred caps 18, 20 will be approximately 0.375 inch in depth.

It is preferred that handle connection means 42, 42' be allowed to connect the first cap 18 and the second cap 20 to a handle means 40. In the embodiment shown, the handle means comprises the center of the caps 18, 20 having a raised protrusion 28 defining a hole 30 therethrough. The raised protrusion being 0.25 inches in height, 0.125 inches thick, having a hole 0.25 inches deep and 0.25 inches across, all preferably centered on the cap 18, 20.

The handle 40 utilized with the preferred embodiment comprises a round metal bar that will fit in the indentations in the middle of the caps 18, 20. In that embodiment, both ends of the round metal bar will extend approximately 1.0 inches from the caps 18, 20, make a right angled bend, be a length 1.0 inch longer than the radius of the cap, make a seventy-five degree corner and arc to the other end of the body 12 in a similar fashion, as shown in FIG. 2.

Referring now to FIG. 2, a cross sectional view of the embodiment of FIG. 1 is shown. This cross sectional view further shows the handle connection means 42, 42' comprising a hole 30 through the first cap 18 and the second cap 20, through which the first end 44 of the handle 40 and the second end 46 of the handle 40 can be inserted. This figure shows that the body 12 is a generally cylindrical tube having a side wall 24.

Figure 3:
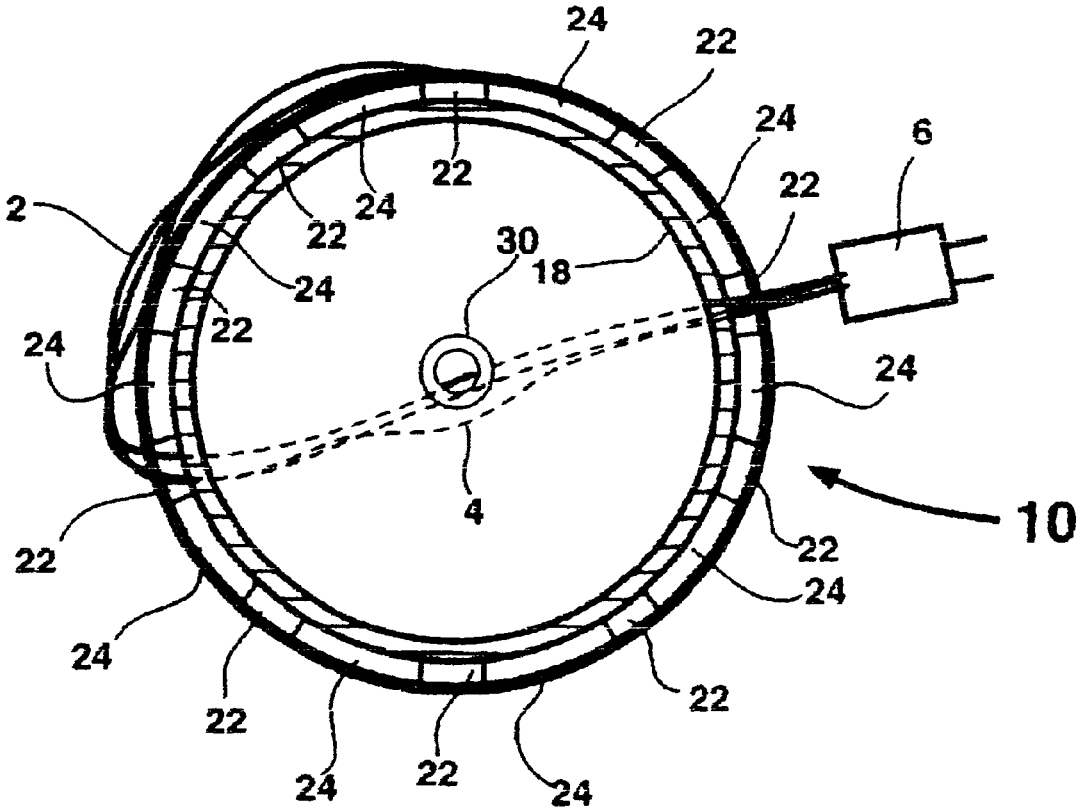
FIG. 3 is a top cross sectional view of the embodiment of FIG. 1.

Referring now to FIG. 3, a partial end view of FIG. 1 is shown. This figure shows side wall 24 having a plurality of slots 22 therethrough. In this embodiment, as well as in the preferred embodiment, the number of notches is eight, with such slots being in opposing pairs.

Figure 4:
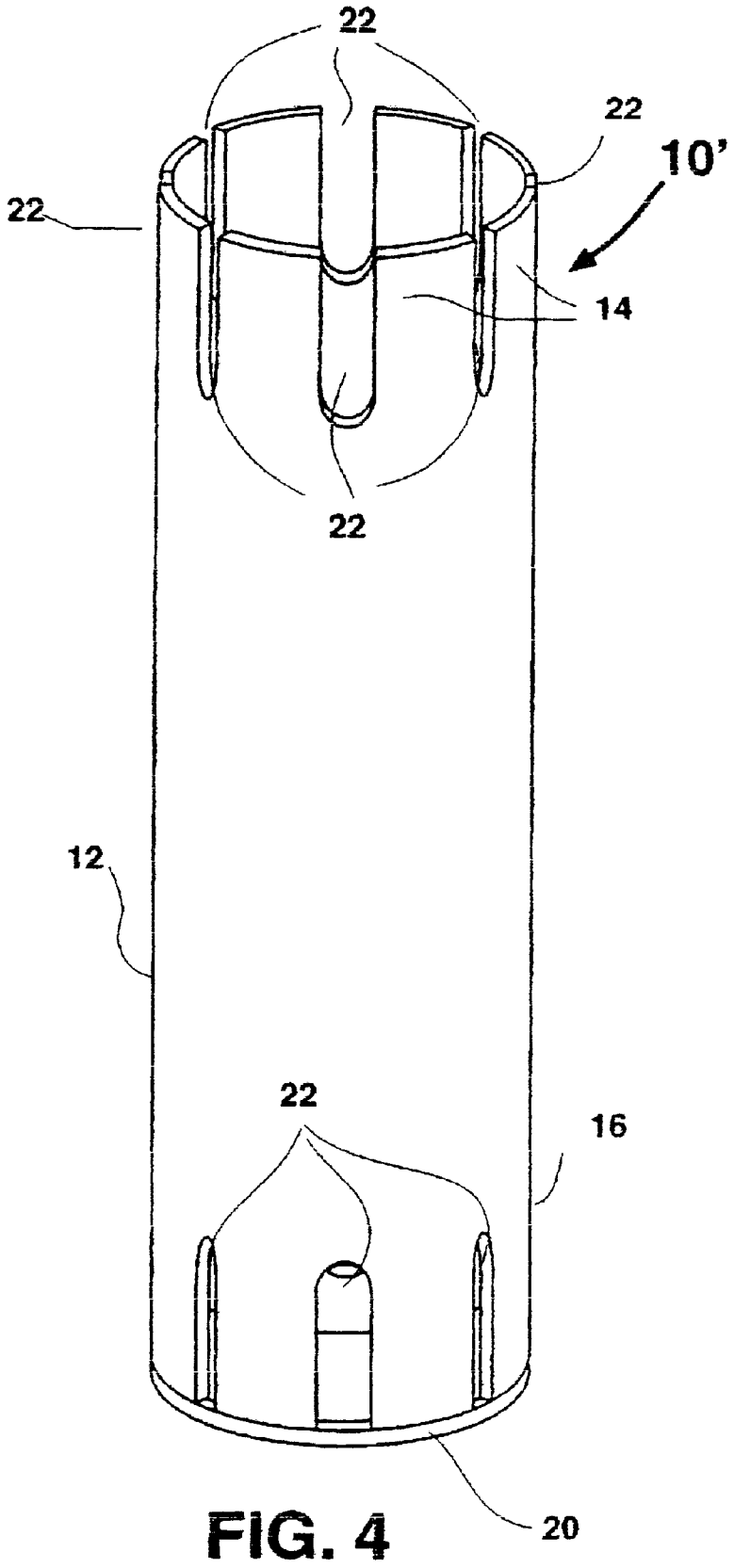
FIG. 4 is a perspective view of one embodiment of the present invention.

Referring now to FIG. 4, a second embodiment of the present invention is shown. In this embodiment, the body 12 has a first end 14 opposite a second end 16. The first and second ends have a plurality of slots 22 therethrough the side wall 24. The body 12 has an exterior surface 26 around which a string of Christmas lights (not shown) can be wound. A cap means 20 is shown attached to the second end 16. The device 10' is not shown having a first cap 18, however such a cap could readily be provided.

Figure 5:
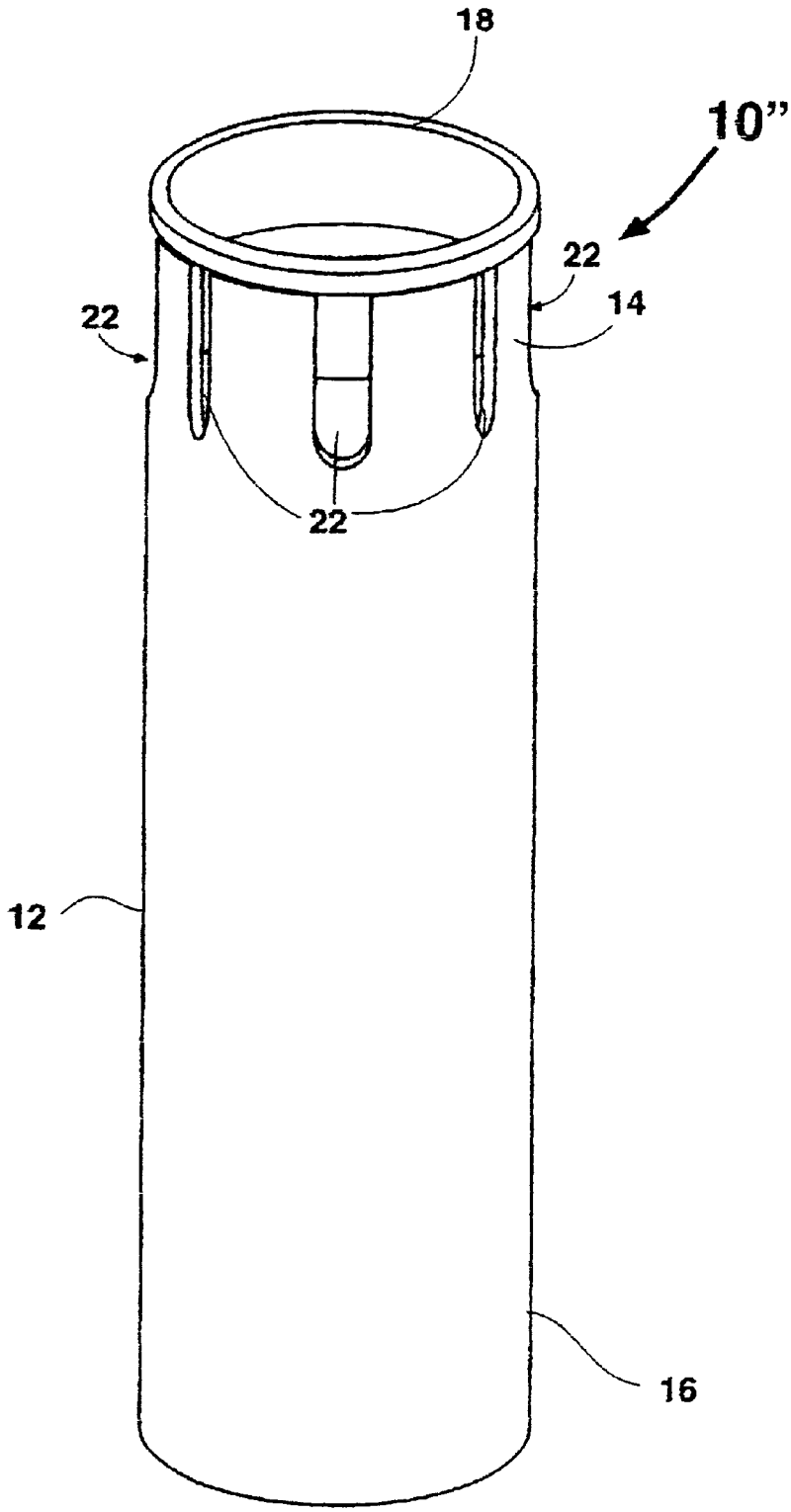
FIG. 5 is a perspective view of a third embodiment of the present invention.
Figure 6:
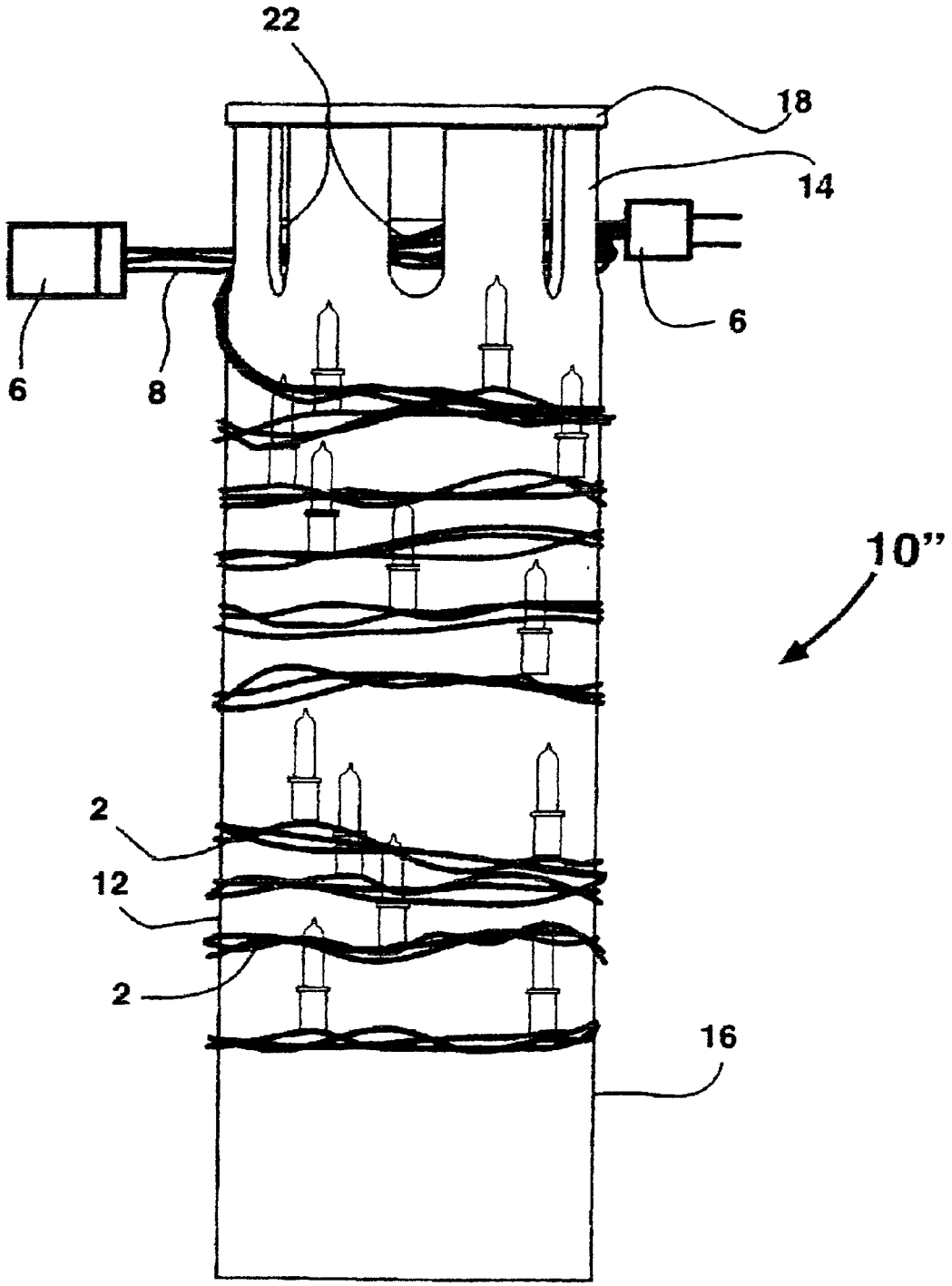
FIG. 6 is a side, environmental view of the embodiment of FIG. 5.

Referring now to FIG. 5, an alternate version of the present invention is shown. This device 10" has a body 12, a first end 14 opposite a second end 16. However, in this embodiment, notches 22 are only present within the first end 14. In use of such an embodiment, the user would insert the first end 4 through the slots, wind the string around the exterior surface 26 of the body 12 and then attaching the second end of the device through same or different slots 22, and finally attaching the cap 18 thereto to the end in order to hold the wound string onto the device 10", as shown in FIG. 6.

While there is shown and described the present preferred embodiment of the invention, it is to be distinctly understood that this invention is not limited thereto but may be variously embodied to practice within the scope of the following claims.

I claim:

1. A storage device for storing at least one string of Christmas lights, said string of Christmas lights having a plurality of light bulbs connected together by wires, said string of Christmas lights having a string first end terminating in a first electrical plug coupled to said wires, said string of Christmas lights having a string second end terminating in a second electrical plug coupled to said wires, said storage device comprising:

a hollow tube having an exterior surface, a sidewall, a length, a first tube end and a second tube end, said first tube end comprising means for holding the light string such that the first electrical plug resides external to the storage device, the means for holding including at least two first end notches directed into said sidewall of said hollow tube, said second tube end comprising means for holding the light string such that the second electrical plug resides external to the storage device, the means for holding including at least two second end notches directed into said sidewall of said hollow tube;

a first end cap removably coupled to said first tube end;

a second end cap removably coupled to said second tube end;

wherein said string of Christmas lights is able to be wound around said exterior surface;

wherein said first end cap is able to be uncoupled from said first tube end, said string first end is able to extend between said first end notches with said first electrical plug extending away from said hollow tube, and said first end cap is able to be coupled to said first tube end thereby fixedly holding said string first end within said first end notches; and wherein said second end cap is able to be uncoupled from said second tube end, said string second end is able to extend between said second end notches with said second electrical plug extending away from said hollow tube, and said second end cap is able to be coupled to said second tube end thereby fixedly holding said string second end within said end notches.

2. The light storage device of claim 1 wherein said first and second end caps further comprise releasable handle attachment means for allowing the light storage device to attach to a handle.

3. The light storage device of claim 1 wherein said hollow tube is generally cylindrical.

4. The light storage device of claim 1 wherein said hollow tube is generally prismatical.

5. The light storage device of claim 1 wherein the number of first end notches is eight and wherein the number of second end notches is eight.

6. A storage device for storing at least one string of Christmas lights, said string of Christmas lights having a plurality of light bulbs connected together by wires, said string of Christmas lights having a string first end terminating in a first electrical plug coupled to said wires, said string of Christmas lights having a string second end terminating in a second electrical plug coupled to said wires, said storage device comprising:

a hollow tube having an exterior surface, a sidewall, a length, a first tube end and a second tube end, said first tube end comprising means for holding the light string such that the first electrical plug resides external to the storage device, the means for holding including at least two first end notches directed into said sidewall of said hollow tube, said second tube end comprising means for holding the light string such that the second electrical plug resides external to the storage device, the means for holding including at least two second end notches directed into said sidewall of said hollow tube;

wherein said string of Christmas lights is able to be would around said exterior surface; and wherein said string first end is able to extend between said first end notches with said first electrical plug extending away from said hollow tube, and wherein said string second end is able to extend between said second end notches with said second electrical plug extending away form said hollow tube.

7. The storage device of claim 6 further comprising a first end cap removably coupled to said first tube end and a second end cap removably coupled to said second tube end.

8. The storage device of claim 7, wherein said first end cap is able to be uncoupled from said first tube end, said string first end is able to extend between said first end notches with said first electrical plug extending away from said hollow tube, and said first end cap is able to be coupled to said first tube end thereby fixedly holding said string first end within said first end notches; and wherein said second end cap is able to be uncoupled from said second tube end, said string second end is able to extend between said second end notches with said second electrical plug extending away from said hollow tube, and said second end cap is able to be coupled to said second tube end thereby fixedly holding said string second end within said second end notches.

9. The light storage device of claim 7 wherein said first and second end caps further comprise releasable handle attachment means for allowing the light storage device to attach to a handle.

10. The light storage device of claim 6 wherein said hollow tube is generally cylindrical.

11. The light storage device of claim 6 wherein said hollow tube is generally prismatical.

12. The light storage device of claim 6 wherein the number of first end notches is eight and wherein the number of second end notches is eight.

13. A storage device for storing a string of Christmas lights, said string of Christmas lights having a plurality of light bulbs connected together by wires, said string of Christmas lights having a plurality of light bulbs connected together by wires, said sting of Christmas lights having a string first end terminating in a first electrical plug coupled to said wires, said string of Christmas lights having a string second end terminating in a second electrical plug coupled to said wires, said storage device comprising:

a hollow cylindrical tube having an exterior surface, a sidewall, a length, a first tube end and a second tube end, said first tube end comprising means for holding the light string such that the first electrical plug resides external to the storage device, the means for holding including a plurality of paired, opposing first end notches directed into said sidewall of said hollow tube, said second tube end comprising means for holding the light string such that the second electrical plug resides external to the storage device, the means for holding including a plurality of paired, opposing second end notches directed into said sidewall of said hollow tube;

a first end cap removably coupled to said first tube end;

a second end cap removably couple to said second tube end;

wherein said string of Christmas lights is able to be wound around said exterior surface;

wherein said first end cap is able to be uncoupled from said first tube end, said string first end is able to extend between one of said pairs of opposing first end notches with said first electrical plug extending away from said hollow tube, and said first end cap is able to be coupled to said first tube end thereby fixedly holding said string first end within said first end notches; and wherein said second end cap is able to be uncoupled from said second tube end, said string second end is able to extend between one of said pairs of opposing second notches with said second electrical plug extending away form said hollow tube, and said second end cap is able to be coupled to said second tube end thereby fixedly holding said string second end within said second end notches.

14. The light storage device of claim 13 wherein said first and second end caps further comprise releasable handle attachment means for allowing the light storage device to attach to a handle.

15. The light storage device of claim 14 wherein said releasable handle attachment means comprises a hole through each of said end caps for receiving a projection extending from said handle.

16. The light storage device of claim 13 wherein said hollow tube is generally cylindrical.

17. The light storage device of claim 13 wherein said hollow tube is generally prismatical.

18. The light storage device of claim 13 wherein the number of first end notches is eight and wherein the number of second end notches is eight.

* * * * *